US008304673B2

(12) United States Patent
Sun

(10) Patent No.: US 8,304,673 B2
(45) Date of Patent: Nov. 6, 2012

(54) PUSH-BUTTON SWITCH WITH DISPLAY SCREEN

(76) Inventor: Jen-Wen Sun, Yonghe (TW)

( * ) Notice: Subject to any disclaimer, the term of this patent is extended or adjusted under 35 U.S.C. 154(b) by 442 days.

(21) Appl. No.: 12/591,665

(22) Filed: Nov. 27, 2009

(65) Prior Publication Data

US 2011/0127149 A1 Jun. 2, 2011

(51) Int. Cl.
*H01H 9/00* (2006.01)

(52) U.S. Cl. ..... 200/314

(58) Field of Classification Search ..... 200/314
See application file for complete search history.

*Primary Examiner* — Renee S Luebke
*Assistant Examiner* — Lheiren Mae Caroc

(74) *Attorney, Agent, or Firm* — Rosenberg, Klein & Lee

(57) ABSTRACT

A push-button switch with display screen includes a seat having an open-topped recess, a top cover located in the recess, a display screen, such as an LCD, an OLED or a TFT-LCD, located in below the top cover, an actuating member located in the recess below the display screen and connected to a microswitch located below the seat, a frame-like light-guiding member located in the recess around a periphery of the top cover, and a circuit board with light-emitting diodes located in the recess below the light-guiding member. The display screen is connected to an external circuit for displaying different dynamic or non-dynamic indicating images. When the light-emitting diodes are turned on to emit light onto the light-guiding member, a bright rim is generated along the periphery of the top cover to highlight the indicating images on the display screen and give the push-button switch a beautiful eye-catching appearance.

5 Claims, 5 Drawing Sheets

PUSH-BUTTON SWITCH WITH DISPLAY SCREEN

FIELD OF THE INVENTION

The present invention relates to a push-button switch with display screen; and more particularly to a push-button switch that includes a display screen for displaying dynamic or non-dynamic indicating images thereon, and a plurality of light-emitting diodes for generating a bright rim to highlight the indicating images on the display screen and give the push-button switch an eye-catching appearance.

BACKGROUND OF THE INVENTION

Push-button switches are widely applied to vending machines, auto-control devices, game machines and slot machines. To indicate the location or the operating function of the push-button switch, the conventional push-button switch usually has a top cover made of a transparent or an opaque material with a printed indicating image or a sticker showing an indicating image attached to the surface of the top cover, and a light source, such as a light-emitting diode or a bulb, arranged below the top cover to emit light for highlighting the indicating image shown on the top cover. However, the light source and the indicating image for the conventional push-button switch provide only fixed visual effect without change, so that the whole push-button switch looks monotonous without attraction.

It is therefore tried by the inventor to develop a push-button switch with display screen to highlight the indicating image on the push-button switch and make the push-button switch visually beautiful and attractive.

SUMMARY OF THE INVENTION

A primary object of the present invention is to provide a push-button switch with a display screen for displaying dynamic or non-dynamic indicating images and a plurality of light-emitting diodes for generating a bright rim along a periphery of the push-button switch to highlight the indicating image on the display screen and make the push-button switch visually beautiful and attractive.

To achieve the above and other objects, the push-button switch with display screen according to the present invention includes a seat having an open-topped recess, a top cover located in the recess, a display screen, such as an LCD, an OLED or a TFT-LCD, located in below the top cover, an actuating member located in the recess below the display screen and connected to a microswitch located below the seat, a frame-like light-guiding member located in the recess around a periphery of the top cover, and a circuit board with light-emitting diodes located in the recess below the light-guiding member. The display screen is connected to an external circuit for displaying different dynamic or non-dynamic indicating images thereon. When the light-emitting diodes are turned on to emit light onto the light-guiding member, a bright rim is generated along the periphery of the top cover to highlight the indicating images on the display screen and give the push-button switch a beautiful eye-catching appearance.

In the present invention, the top cover is made of a transparent material, so that the indicating images displayed on the display can be directly seen from outside of the top cover.

In the present invention, the seat has a sleeve downward extended from a center of the recess, and the actuating member has a hollow post downward extended from at a center thereof. The post of the actuating member has a spring fitted therearound and is fitted in the sleeve of the seat to connect to the upper end of the microswitch. Thus, when the top cover is downward pushed, the spring is compressed and the microswitch is on, and when the top cover is released, the actuating member is returned to its home position by an elastic restoring force of the spring and the microswitch is off.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
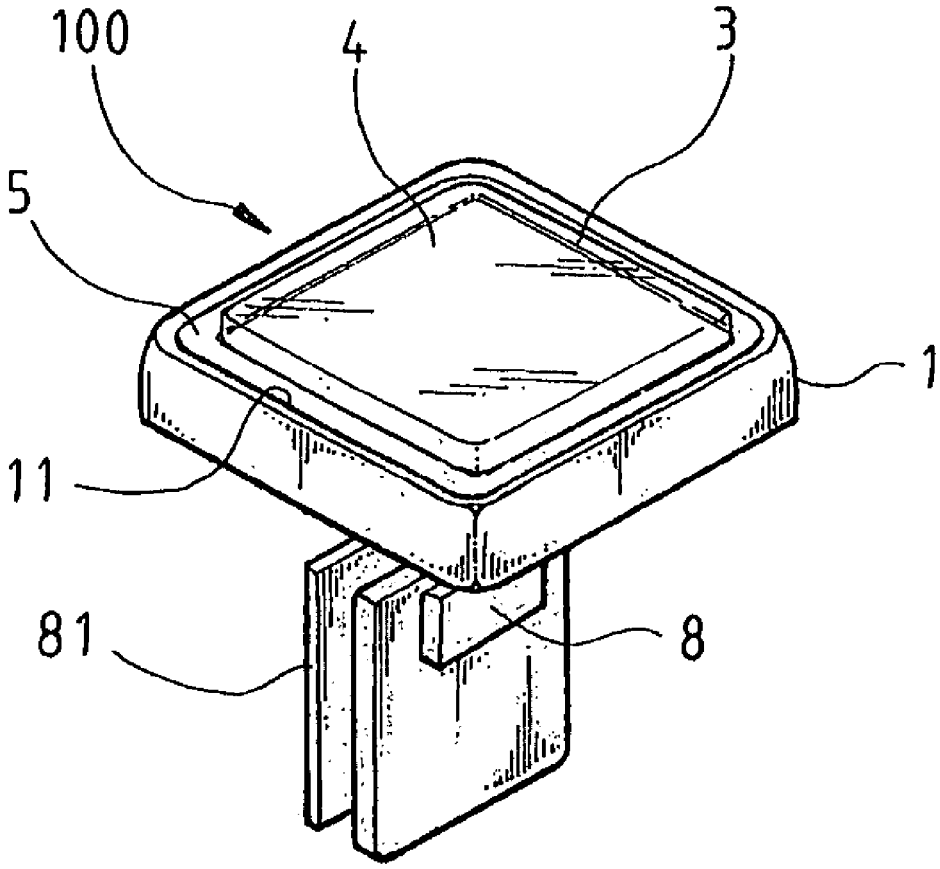
FIG. 1 is an assembled perspective view of a push-button switch with display screen according to a first embodiment of the present invention.
Figure 2:
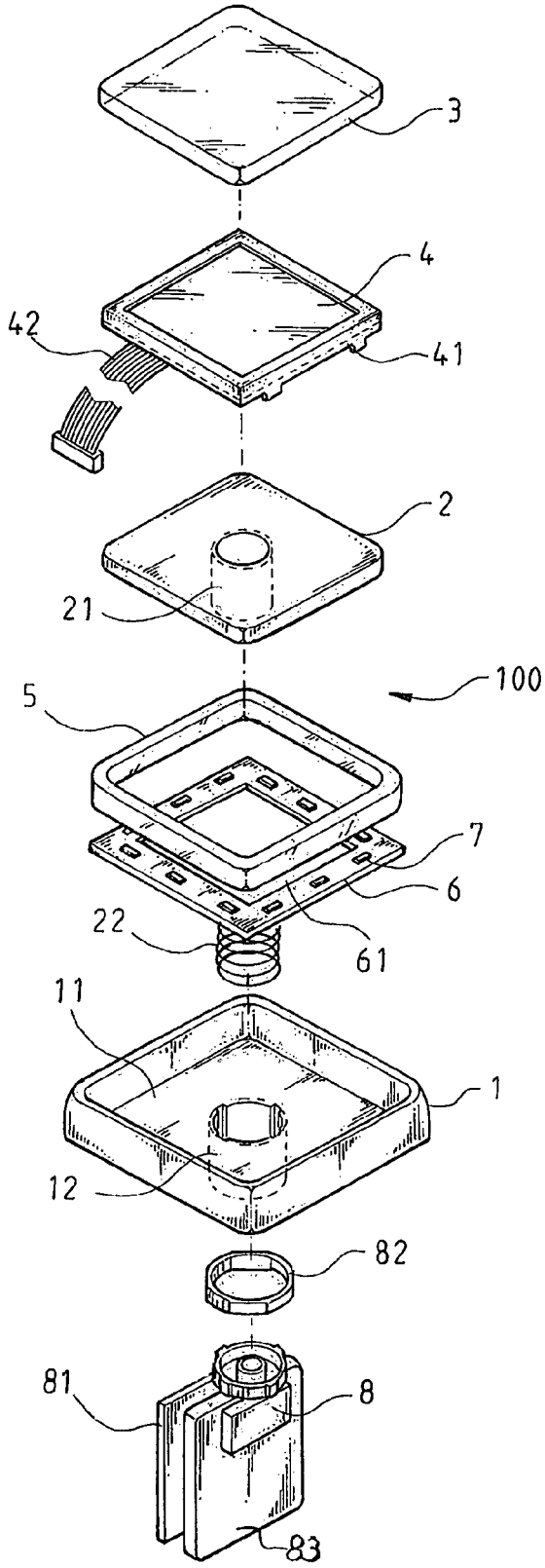
FIG. 2 is an exploded view of FIG. 1.

Please refer to FIGS. 1 and 2 that are assembled and exploded perspective views, respectively, of a push-button switch with display screen 100 according to a first embodiment of the present invention. As shown, the push-button switch with display screen in the first embodiment includes a seat 1, an actuating member 2, a top cover 3, a display screen 4, a light-guiding member 5, a circuit board 6, and a microswitch 8.

The seat 1 defines an open-topped recess 11 having a predetermined depth, and includes a sleeve 12 downward extended from a center of the recess 11 by a predetermined length. The seat can be made of a transparent material.

The actuating member 2 is disposed in the recess 11 and has a hollow post 21 downward extended from a center thereof for extending into the sleeve 12 of the seat 1 with a spring 22 fitted around the post 21.

The top cover 3 is made of a transparent material and disposed in the recess 11 of the seat 1 above the actuating member 2.

The display screen 4 can be a liquid crystal display (LCD), an organic LED (OLED) or a thin film transistor (TFT) LCD, and is located in below the top cover 3. The display screen 4 is connected to a circuit board 41, which is further connected to an external circuit via a cable 42 extended through the hollow post 21 of the actuating member 2.

The light-guiding member 5 is located in the recess 11 around a periphery of the top cover 3.

The circuit board 6 is located in the recess 11 below the light-guiding member 5 and has a central opening 61, via which the post 21 of the actuating member 2 is extended into the sleeve 12 of the seat 1. A plurality of spaced light-emitting diodes 7 is arranged along a top of the circuit board 6 corresponding to the light-guiding member 5.

The microswitch 8 is fixedly mounted on a mounting base 83 with an upper end of the microswitch 8 connected and secured to the post 21 of the actuating member 2 using a locking ring 82.

In the push-button switch 100, the display screen 4 can be driven by the external circuit connected thereto to display different dynamic or non-dynamic indicating images. With the light-guiding member 5 located around the top cover 3 and the circuit board 6 provided with the light-emitting diodes 7 disposed below the light-guiding member 5, light emitted from the light-emitting diodes 7 can irradiate on the light-guiding member 5 and be guided by the light-guiding member 5 to generate a bright rim along the periphery of the top cover 3. The bright rim highlights the indicating images on the display screen 4 and gives the push-button switch 100 a beautiful and eye-catching appearance.

Figure 3:
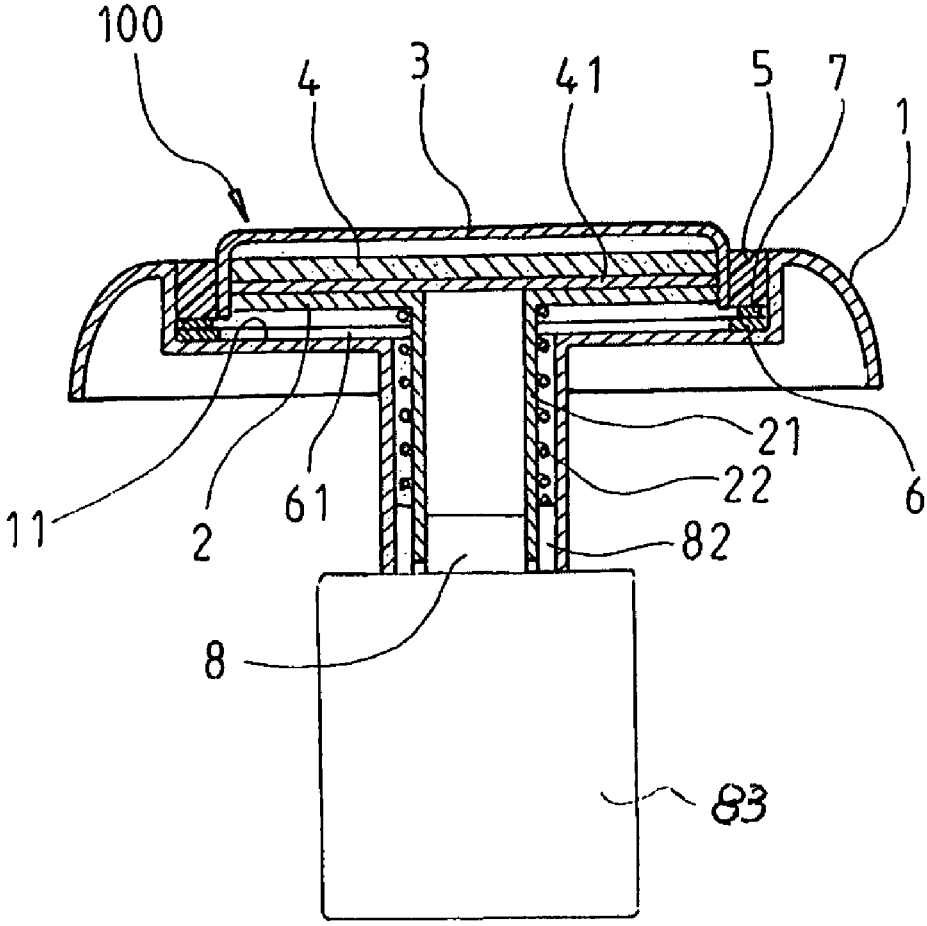
FIG. 3 is a sectional view of FIG. 1.

Please now refer to FIG. 3, which is an assembled sectional view of the push-button switch with display screen 100 shown in FIG. 1. As shown, the display screen 4 and the actuating member 2 are located in below the top cover 3 with the post 21 downward projected from the top cover 3 to extend through the light-guiding member 5, the circuit board 7, and the sleeve 21 of the seat 1 to connect to the microswitch 8. Therefore, by pushing or releasing the top cover 3, the post 21 of the actuating member 2 is pushed against or released from the microswitch 8 to thereby control the on/off of the microswitch 8. And, the light-guiding member 5 is located around the top cover 3 above the light-emitting diodes 7 on the circuit board 6. Therefore, when the light-emitting diodes 7 on the circuit board 6 are turned on to emit light, the emitted light is projected onto a lower side of the light-guiding member 5 and guided by the light-guiding member 5 to generate a bright rim along the periphery of the top cover 3. With these arrangements, the dynamic or non-dynamic indicating images displayed on the display screen 4 of the push-button switch 100 can be directly seen from outside of the top cover 3, and the bright rim shown along the periphery of the top cover 3 highlights the displayed indicating images and gives the push-button switch 100 a beautiful and eye-catching appearance.

Figure 4:
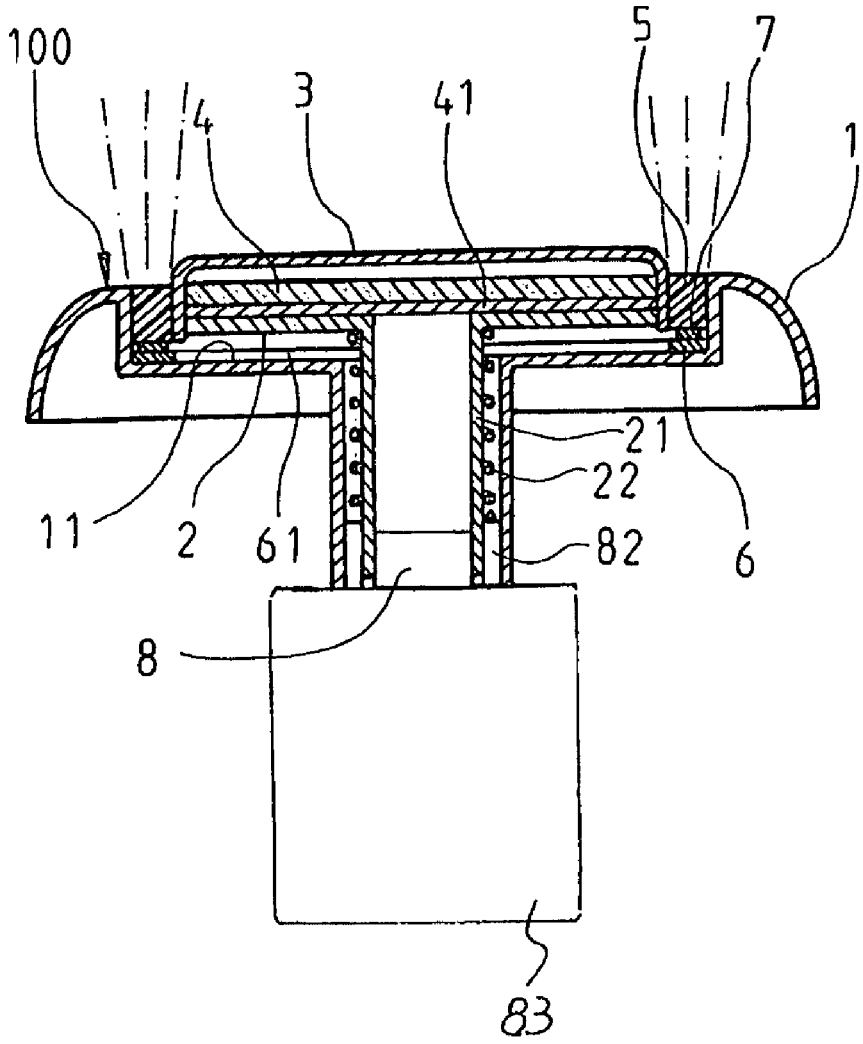
FIG. 4 is a sectional view showing the operation of the push-button switch of FIG. 1.

Please refer to FIG. 4, which shows the operation of the push-button switch 100 of the present invention. As shown, the light-guiding member 5 is located around the top cover 3 corresponding to the light-emitting diodes 7 on the circuit board 6. When the light-emitting diodes 7 on the circuit board 6 are turned on to emit light, the emitted light is projected onto a lower side of the light-guiding member 5 and guided by the light-guiding member 5 to generate a bright rim along the periphery of the top cover 3. The bright rim not only gives the push-button switch 100 a beautiful and eye-catching appearance, but also highlights the dynamic or non-dynamic indicating images shown on the display screen 4. And, with the actuating member 2 located in below the top cover 3, whenever the top cover 3 is pushed, the post 21 of the actuating member 2 is pushed against the microswitch 8, so that the microswitch 8 is on; and when the top cover 3 is released, the actuating member 2 is returned to its home position by an elastic restoring force of the spring 22, and the microswitch 8 is off. With these arrangements, the dynamic or non-dynamic indicating images displayed on the display screen 4 of the push-button switch 100 can be directly seen from outside of the top cover 3, and the bright rim shown along the periphery of the top cover 3 highlights the displayed indicating images and gives the push-button switch 100 a beautiful and eye-catching appearance.

Figure 5:
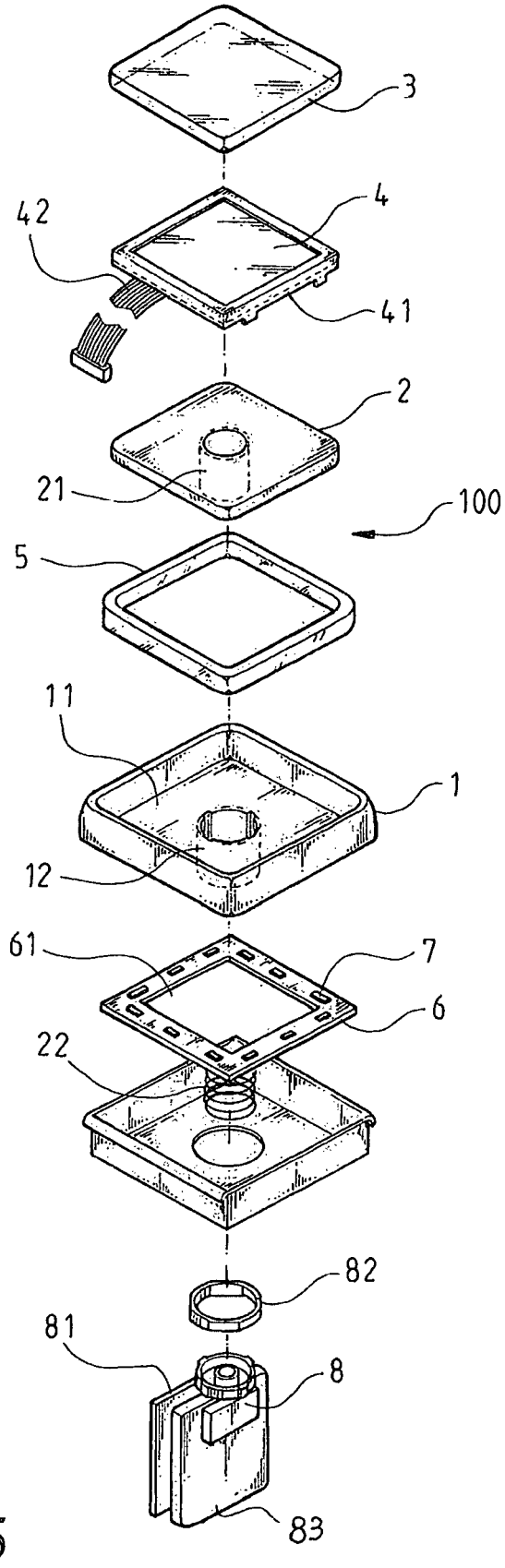
FIG. 5 is an exploded perspective view of a push-button switch with display screen according to a second embodiment of the present invention.

FIG. 5 is an exploded perspective view of a push-button switch with display screen 100 according to a second embodiment of the present invention. The second embodiment is generally structurally similar to the first embodiment, except that the circuit board 6 is located below the transparent seat 1. When the light-emitting diodes 7 on the circuit board 6 are turned on to emit light, the emitted light is projected onto and guided by the seat 1 and the light-guiding member 5 to brighten the seat 1 and the periphery of the top cover 3, so that the display effect of the display screen is enhanced and the push-button switch 100 looks more beautiful.

In conclusion, in the present invention, the light-guiding member cooperates with the circuit board with the light-emitting diodes to generate a bright rim around the top cover, so that the push-button switch provides enhanced display effect and has a beautiful appearance.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A push-button switch with display screen, comprising:

a seat having an open-topped recess of a predetermined depth defined therein, and a sleeve extending downward from a center of the recess by a predetermined length;

an actuating member located in the recess of the seat and having a hollow post extending downward from a center thereof;

a top cover located in the recess of the seat above the actuating member;

a display screen located below the top cover and above the actuating member to connect with a first circuit board, and the first circuit board connected to an external circuit via a cable;

a light-guiding member located in the recess of the seat around a periphery of the top cover;

a second circuit board provided with a plurality of light-emitting diodes spaced along a periphery of a top of the second circuit board corresponding to the light-guiding member and the seat for emitting light to irradiate on the light-guiding member and the seat; and a microswitch fixedly mounted on a mounting base below the seat, an upper end of the microswitch connected to the post of the actuating member, such that the microswitch is on when the top cover is pushed downward;

whereby when the display screen is driven by the externally connected circuit, different dynamic or non-dynamic indicating images are displayed on the display screen; and when the light-emitting diodes on the second circuit board are turned on to emit light, the emitted light is irradiated on and guided by the light-guiding member to generate a bright rim along the periphery of the top cover to thereby enable an enhanced display effect of the display screen.

2. The push-button switch with display screen as claimed in claim 1, wherein the post of the actuating member has a spring fitted therearound and is fitted in the sleeve of the seat to connect to the upper end of the microswitch; whereby when the top cover is pushed downward, the spring is compressed and the microswitch is on, and when the top cover is released, the actuating member is returned to its home position by an elastic restoring force of the spring and the microswitch is off.

3. The push-button switch with display screen as claimed in claim 1, wherein the top cover is made of a transparent material, allowing the indicating images displayed on the display screen to be seen directly from outside of the top cover.

4. The push-button switch with display screen as claimed in claim 1, wherein the seat is made of a transparent material, allowing the light emitted by the light-emitting diodes to pass through and illuminate the seat.

5. The push-button switch with display screen as claimed in claim 1, wherein the second circuit board is located below the actuating member and the light-guiding member and is formed with a central opening, and the post of the actuating member is extended through the central opening of the second circuit board into the sleeve of the seat.

* * * * *